US007717090B2

(12) United States Patent
Honda et al.

(10) Patent No.: US 7,717,090 B2
(45) Date of Patent: May 18, 2010

(54) FUEL-FEEDING DEVICES

(75) Inventors: Yoshihiko Honda, Obu (JP); Tomoaki Inoue, Nagoya (JP); Koji Yoshida, Kasugai (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 0 days.

(21) Appl. No.: 12/246,714

(22) Filed: Oct. 7, 2008

(65) Prior Publication Data

US 2009/0151699 A1 Jun. 18, 2009

(30) Foreign Application Priority Data

Dec. 12, 2007 (JP) ..... 2007-320659

(51) Int. Cl.
*F02M 37/04* (2006.01)

(52) U.S. Cl. ..... 123/509; 123/510; 123/511

(58) Field of Classification Search ..... 123/509, 123/510, 511, 514; 417/189
See application file for complete search history.

(56) References Cited

U.S. PATENT DOCUMENTS 4,926,829 A * 5/1990 Tuckey ..... 123/497
5,148,792 A * 9/1992 Tuckey ..... 123/497
5,220,941 A * 6/1993 Tuckey ..... 137/510
5,289,810 A * 3/1994 Bauer et al. ..... 123/510
5,361,742 A * 11/1994 Briggs et al. ..... 123/506
5,398,655 A * 3/1995 Tuckey ..... 123/456
5,533,478 A * 7/1996 Robinson ..... 123/510
5,692,479 A * 12/1997 Ford et al. ..... 123/514
5,715,798 A * 2/1998 Bacon et al. ..... 123/514
5,727,529 A * 3/1998 Tuckey ..... 123/514
5,749,345 A * 5/1998 Treml ..... 123/456
5,752,486 A * 5/1998 Nakashima et al. ..... 123/467
5,762,048 A * 6/1998 Yonekawa ..... 123/514
5,791,317 A * 8/1998 Eck ..... 123/510
5,873,349 A * 2/1999 Tuckey et al. ..... 123/514
6,024,064 A * 2/2000 Kato et al. ..... 123/179.17
6,068,022 A * 5/2000 Schultz et al. ..... 137/538
6,253,740 B1 * 7/2001 Rembold ..... 123/509
6,260,543 B1 * 7/2001 Chih ..... 123/509
6,343,589 B1 * 2/2002 Talaski et al. ..... 123/514
6,520,163 B2 * 2/2003 Yoshioka et al. ..... 123/510
6,729,309 B2 * 5/2004 Schueler ..... 123/514

(Continued)

FOREIGN PATENT DOCUMENTS

JP 2005069171 3/2005

*Primary Examiner*—Thomas N Moulis
(74) *Attorney, Agent, or Firm*—Dennison, Schultz & MacDonald

(57) ABSTRACT

A fuel-feeding device may preferably include a reservoir cup disposed in a fuel tank that contains liquid fuel therein, a fuel pump capable of feeding the liquid fuel contained in the reservoir cup to an engine, a pressure regulator capable of controlling a fuel pressure of the liquid fuel fed to the engine from the fuel pump, a jet pump arranged and constructed to receive a part of the pressurized liquid fuel pumped from the fuel pump via a fuel jet path, so as to introduce liquid fuel outside the reservoir cup into to the reservoir cup with the aid of flow of the pressurized liquid fuel, and a flow rate control valve disposed in the fuel jet path. The flow rate control valve is arranged and constructed to control a flow rate of the pressurized liquid fuel fed to the jet pump depending upon a pumping rate of the pressurized liquid fuel pumped from the fuel pump.

6 Claims, 5 Drawing Sheets

U.S. PATENT DOCUMENTS

| | | | | |
|---|---|---|---|---|
| 6,805,106 | B2 * | 10/2004 | Kumagai et al. | 123/514 |
| 6,953,026 | B2 * | 10/2005 | Yu et al. | 123/510 |
| 6,966,305 | B2 * | 11/2005 | Aubree et al. | 123/509 |
| 7,316,222 | B2 * | 1/2008 | Danjyo | 123/509 |
| 7,370,640 | B2 * | 5/2008 | Dickenscheid | 123/510 |
| 7,383,821 | B2 * | 6/2008 | Gras et al. | 123/509 |
| 7,431,020 | B2 * | 10/2008 | Ramamurthy | 123/497 |
| 7,458,362 | B2 * | 12/2008 | Hazama et al. | 123/457 |
| 2002/0043253 | A1 * | 4/2002 | Begley et al. | 123/497 |
| 2003/0015238 | A1 * | 1/2003 | Martin | 137/384 |
| 2003/0111050 | A1 * | 6/2003 | Schueler | 123/446 |
| 2005/0161027 | A1 * | 7/2005 | Maroney | 123/510 |

* cited by examiner

FUEL-FEEDING DEVICES

This application claims priority to Japanese patent application serial number 2007-320659, the contents of which are incorporated herein by reference.

BACKGROUND OF THE INVENTION

The present invention relates to a fuel-feeding device for feeding liquid fuel contained in a fuel tank of an automobile to an automobile engine (an internal-combustion engine).

A fuel-feeding device is taught by, for example, Japanese Laid-Open Patent Publication No. 2005-69171. This fuel-feeding device includes a reservoir cup disposed in a fuel tank, a fuel pump capable of feeding (pumping) liquid fuel contained in the fuel tank to an engine via a feeding port, a pressure regulator capable of controlling a pressure of the liquid fuel fed to the engine (i.e., a fuel pressure), and a jet pump. The jet pump is arranged and constructed to inject the pressurized liquid fuel pumped from a relief port of the fuel pump into the reservoir cup, thereby introducing (drawing) the liquid fuel outside of the reservoir cup into the reservoir cup with the injected liquid fuel.

However, according to the known fuel-feeding device, it is not possible to control a flow rate of the liquid fuel pumped from the relief port of the fuel pump. Therefore, when the liquid fuel is pumped from the feeding port of the fuel pump to the engine in a reduced flow rate, a flow rate of the liquid fuel from the relief port of the fuel pump toward the jet pump can be relatively higher than the flow rate of the liquid fuel from the feeding port of the fuel pump toward the engine. That is, when a reduced volume of liquid fuel is pumped from the fuel pump, a substantial portion of the pumped liquid fuel is fed to the jet pump and not to the engine. Therefore, even if the reduced volume of liquid fuel should be fed to the engine, the fuel pump must be actuated to pump a relatively large volume of liquid fuel. That is, the fuel pump must be actuated at a relatively high speed (large load) in order to feed the reduced volume of liquid fuel to the engine. This means that when the reduced volume of liquid fuel should be fed to the engine, the fuel pump must be wastefully actuated.

Thus, there is a need in the art for an improved fuel-feeding device for feeding liquid fuel of an engine.

BRIEF SUMMARY OF THE INVENTION

For example, in one embodiment of the present invention, a fuel-feeding device may include a reservoir cup disposed in a fuel tank that contains liquid fuel therein, a fuel pump capable of feeding the liquid fuel contained in the reservoir cup to an engine, a pressure regulator capable of controlling a fuel pressure of the liquid fuel fed to the engine from the fuel pump, a jet pump arranged and constructed to receive a part of the pressurized liquid fuel pumped from the fuel pump via a fuel jet path, so as to introduce liquid fuel outside the reservoir cup into to the reservoir cup with the aid of flow of the pressurized liquid fuel, and a flow rate control valve disposed in the fuel jet path. The flow rate control valve is arranged and constructed to control a flow rate of the pressurized liquid fuel fed to the jet pump depending upon a pumping rate of the pressurized liquid fuel pumped from the fuel pump.

According to the fuel-feeding device thus constructed, the liquid fuel in the reservoir cup can be fed to the engine by the fuel pump. Further, a pressure of the liquid fuel pumped out of the fuel pump can be controlled by the pressure regulator. Further, the pressurized liquid fuel pumped out of the fuel pump can be fed to the jet pump via the fuel jet path. The jet pump can be actuated with the aid of flow of the liquid fuel, so that the liquid fuel outside of the reservoir cup is introduced into the reservoir cup. The flow rate control valve may preferably change a flow rate of the pressurized liquid fuel fed to the jet pump depending upon a pumping rate of the pressurized liquid fuel pumped from the fuel pump. Therefore, when the pumping rate of the liquid fuel pumped from the fuel pump is low, the flow rate of the pressurized liquid fuel fed to the jet pump may preferably be reduced. As a result, a flow rate of the liquid fuel fed to the engine may preferably be prevented from being excessively reduced. Thus, it is not necessary to actuate the fuel pump 16 at a relatively high speed in order to fed the reduced volume of liquid fuel to the engine. In other words, when the reduced volume of liquid fuel should be fed to the engine, a load applied to the fuel pump can be effectively reduced.

Other objects, features, and advantages, of the present invention will be readily understood after reading the following detailed description together with the accompanying drawings and the claims.

DETAILED DESCRIPTION OF THE INVENTION

Next, the representative embodiments of the present invention will be described with reference to the drawings.

First Embodiment

A first embodiment of the present invention will be described with reference to FIGS. 1 and 2. This embodiment of the present invention is directed to a fuel-feeding device for use in a vehicle engine.

Figure 1:
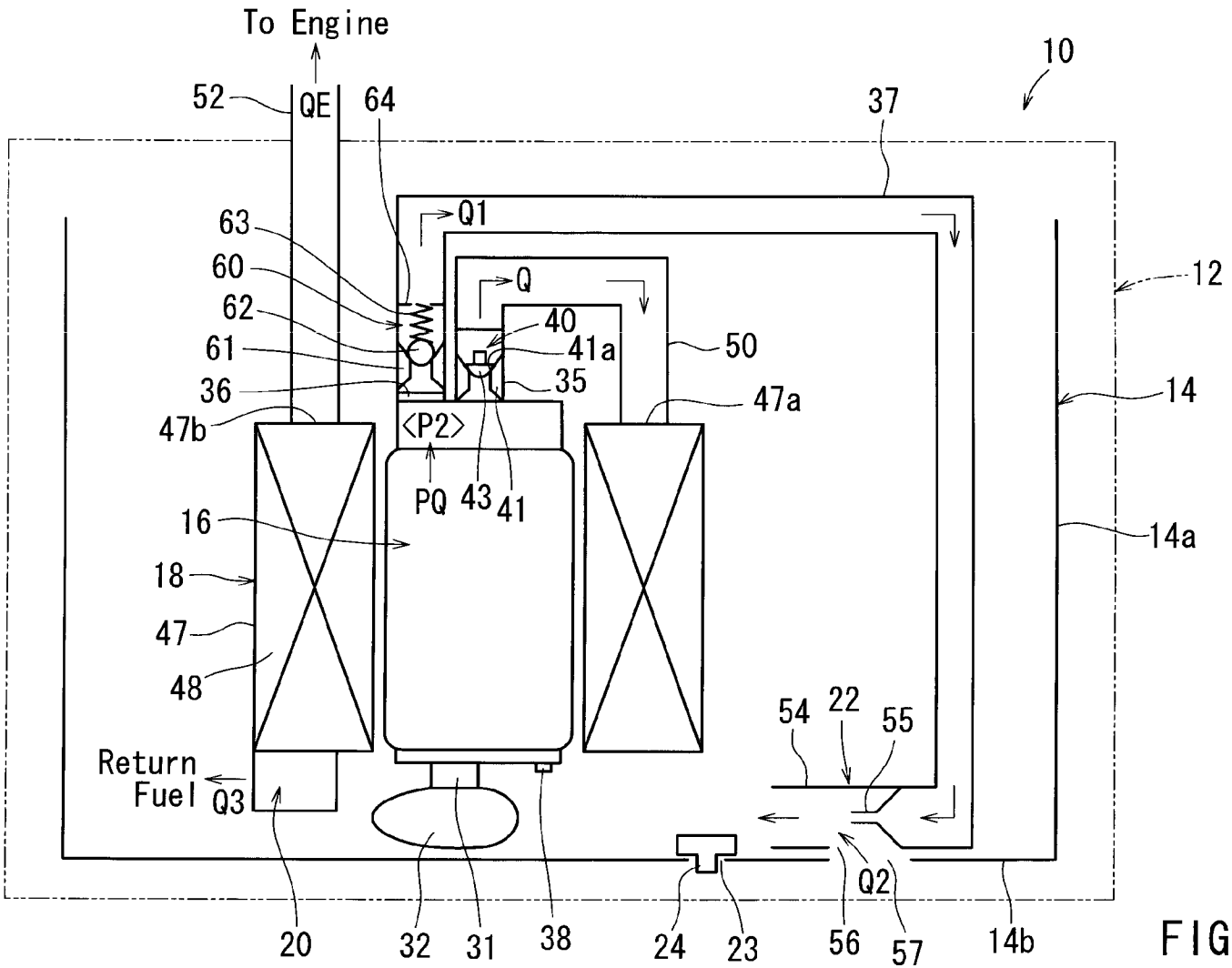
FIG. 1 is a schematic diagram of a fuel-feeding device according to a first embodiment of the present invention.
Figure 2:
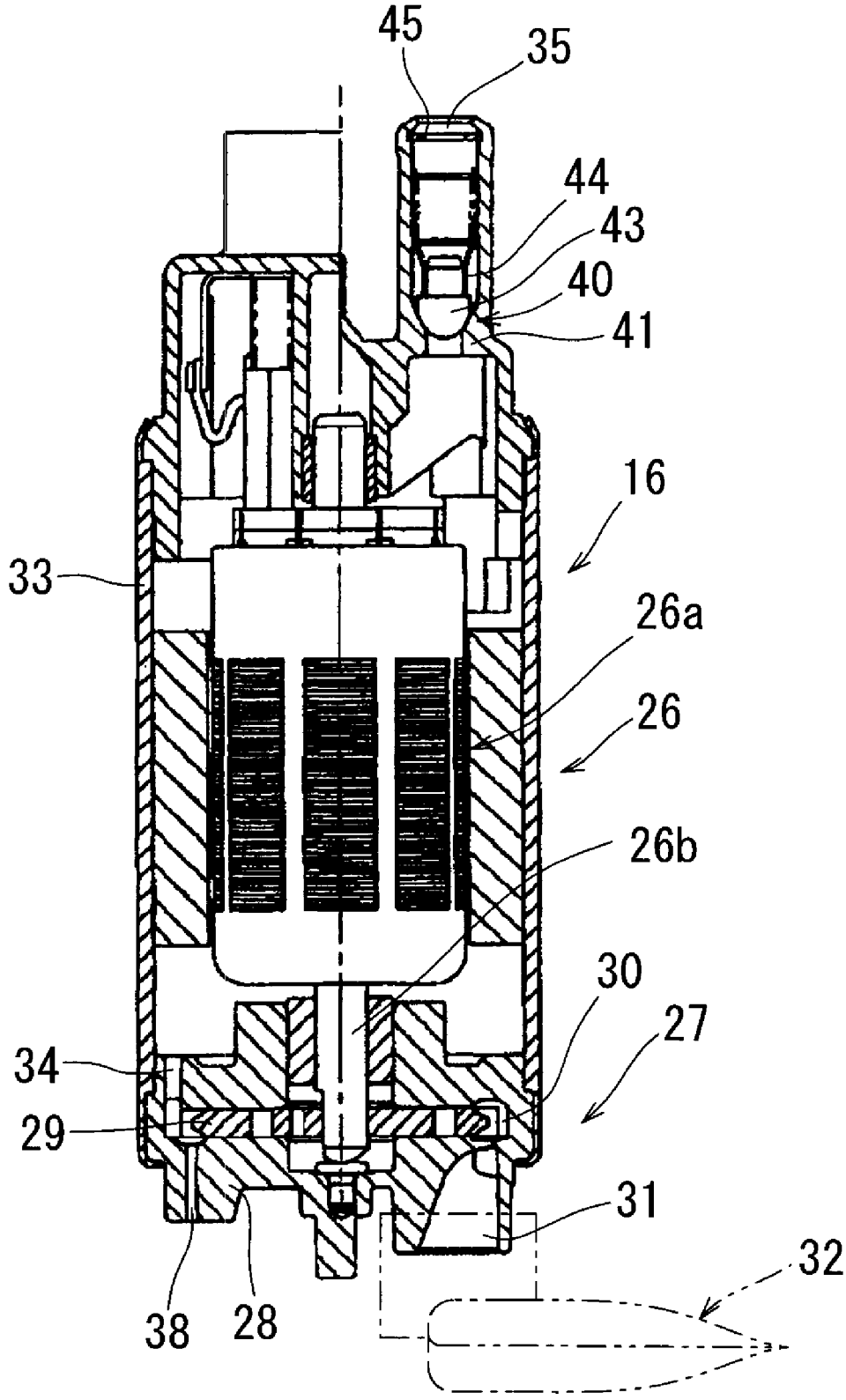
FIG. 2 is a cross-sectional view of a fuel pump used in the fuel-feeding device.

As shown in FIG. 1, the fuel-feeding device 10 may preferably be disposed in a fuel tank 12 of a vehicle (not shown) in which liquid fuel is contained. The fuel-feeding device 10 may preferably include a reservoir cup 14, an immersion type fuel pump 16 capable of feeding (pumping) the liquid fuel contained in the fuel tank 12 to an engine (not shown), a fuel filter 18, a pressure regulator 20 capable of controlling a pressure (i.e., a fuel pressure) of the liquid fuel fed to the engine, and a jet pump 22. The pressure regulator 20 is attached to the fuel pump 16.

The reservoir cup 14 (which may be referred to as a reservoir container or a sub-tank) may preferably be positioned on a bottom surface of the fuel tank 12. The reservoir cup 14 may preferably have a cylindrical cup shape and having a cylindrical side 6*a* wall portion 14*a* and a bottom wall portion 14*b*. A valve port 23 is formed in the bottom wall portion 14*b* of the reservoir cup 14. A check valve 24 is attached to the valve port 23. The check valve 24 is arranged and constructed to be opened when a pressure of the liquid fuel outside of the reservoir cup 14 is higher than the pressure of the liquid fuel inside of the reservoir cup 14, thereby allowing flow of the liquid fuel outside of the reservoir cup 14 into the reservoir cup 14. Also, the check valve 24 is arranged and constructed to be closed when the pressure of the liquid fuel outside of the reservoir cup 14 is lower than the pressure of the liquid fuel inside of the reservoir cup 14, thereby preventing reverse flow of the liquid fuel inside of the reservoir cup 14 toward outside of the reservoir cup 14.

The fuel pump 16 is disposed in the reservoir cup 14. As shown in FIG. 2, the fuel pump 16 may preferably be composed of a motor portion 26 and a pump portion 27. That is, the fuel pump 16 is constructed as a fuel pump integrated with a motor. The motor portion 26 may preferably have a motor housing 33, and an electric motor 26*a* that is disposed in the motor housing 33. Conversely, the pump portion 27 may preferably have a pump housing 28 that is attached to the motor housing 33, and an impeller 29 that is operatively disposed in the pump housing 28.

The pump housing 28 has an annular pump cavity 30 that extends along a periphery of the impeller 29. The pump cavity 30 may preferably have a C-shape in cross section. Also, the pump housing 28 has a fuel inlet port 31 that communicates with the pump cavity 30 and opening into the reservoir cup 14. The fuel inlet port 31 may preferably be provided with a fuel filtering bag 32 that is disposed in the reservoir cup 14. Further, the pump housing 28 has a fuel outlet port 34 that communicates with the pump cavity 30 and opening into the motor housing 33. The impeller 29 of the pump portion 27 is coupled to a motor shaft 26*b* of the motor 26*a*, so as to be rotated when the motor 26*a* is actuated. As will be appreciated, upon rotation of the impeller 29, the liquid fuel in the reservoir cup 14 (the fuel tank 12) can be introduced into the motor housing 33 via the fuel inlet port 31, the pump cavity 30 and the fuel outlet port 34.

Further, the pump housing 28 has a vapor jet port (a relief port) 38 that communicates with the pump cavity 30 and opening into the reservoir cup 14. The vapor jet port 38 is arranged and constructed to discharge a vapor-containing liquid fuel (a vaporized fuel) in the pump cavity 30 into the reservoir cup 14 therethrough.

The motor housing 33 of the fuel pump 16 has a pair of (first and second) outlet ports 35 and 36 (FIG. 1) that are juxtaposed to each other. The first and second outlet ports 35 and 36 communicate with the pump cavity 30 via the fuel outlet port 34 and are arranged and constructed such that the liquid fuel introduced into the motor housing 33 can be pumped out therethrough. As shown in FIG. 1, the first outlet port 35 communicates with the engine via a first conduit pipe 50, the fuel filer 18 and a second conduit pipe 52. Thus, the fuel pump 16 (the fuel inlet port 31, the pump cavity 30, the fuel outlet port 34, the motor housing 33 and the first outlet port 35), the first conduit pipe 50, the fuel filer 18 and the second conduit pipe 52 communicate with each other, so as to constitutes a continuous path. This path may be referred to as a fuel feeder path. The fuel feeder path thus formed may preferably communicate between the fuel pump 16 and the engine. Conversely, the second outlet port 36 is positioned upstream of the first outlet port 35 in the fuel feeder path and communicates with the jet pump 22 via a fuel jet conduit pipe 37. The fuel jet conduit pipe 37 constitutes a continuous path, which path may be referred to as a fuel jet path or branched path.

Thus, the fuel jet path is substantially branched from the fuel feeder path between the pump portion 27 of the fuel pump 16 and the pressure regulator 20 via the second outlet port 36 that is positioned upstream of the first outlet port 35. Further, the second outlet port 36 constitutes a branching portion of the fuel jet path.

As best shown in FIG. 1, a pressure holding valve 40 is disposed in the first outlet port 35. The pressure holding valve 40 may preferably be composed of a squeezing portion 41, a valve seat 41*a* formed in a downstream side (an upper side in FIG. 1) of the squeezing portion 41, a valve body 43, a coil spring 44 (FIG. 2), and a spring stopper 45 (FIG. 2) secured to the first outlet port 35 by crimping. The valve body 43 is movably disposed so as to move toward and away from the valve seat 41*a*. The coil spring 44 is positioned between the valve body 43 and the spring stopper 45, so as to prevent the valve body 43 from inclining.

When the liquid fuel is pumped upon actuation of the fuel pump 16 (upon starting of the engine), the valve body 43 can be spaced away from the valve seat 41*a* by a pressure of the pumped liquid fuel. As a result, the pressure holding valve 40 can be opened, so that the liquid fuel can be fed to the first conduit pipe 50 via the first outlet port 35. Conversely, when the fuel pump 16 is deactuated (when the engine is stopped), the valve body 43 can be pressed to the valve seat 41*a* by a pressure of the liquid fuel in the first conduit pipe 50, so that the pressure holding valve 40 can be closed. As a result, a residual pressure of the liquid fuel in the first conduit pipe 50 can be maintained.

As previously described, the fuel jet path is branched from the fuel feeder path between the pump portion 27 of the fuel pump 16 and the pressure regulator 20 via the branching portion (the second outlet port 36) that is positioned upstream of the first outlet port 35. This means that the squeezing portion 41 (which may be referred to as a fuel feeder path squeezing portion) of the pressure holding valve 40 is positioned downstream of the branching portion (the second outlet port 36) in the fuel feeder path between the pump portion 27 of the fuel pump 16 and the pressure regulator 20, because the pressure holding valve 40 is disposed in the first outlet port 35.

As shown in FIG. 1, the fuel filter 18 is disposed in the reservoir cup 14 so as to encircle the fuel pump 16. The fuel filter 18 may preferably be composed of a filter housing 47 having various shapes (e.g., circular shape, D-shape and C-shape) in cross section and a filter element 48 received in the filter housing 47. An inlet port 47*a* is formed in an upper wall of the filter housing 47. The inlet port 47*a* is connected to the first outlet port 35 of the fuel pump 16 via the first fuel conduit 50. Further, an outlet port 47*b* is formed in the upper wall of the filter housing 47. The outlet port 47*b* is connected to the engine via the second fuel conduit 52. In particular, the outlet port 47*b* is connected to a delivery tube (not shown) having injectors or fuel injection valves (not shown) via the second fuel conduit 52. Therefore, the liquid fuel pumped from the first outlet port 35 of the fuel pump 16 can be fed to the delivery tube via the first fuel conduit 50, the fuel filter 18 and the second fuel conduit 52 and then be injected into combustion chambers (not shown) via the injectors.

As shown in FIG. 1, the pressure regulator 20 is attached to a lower wall of the filter housing 47 of the fuel filter 18. The pressure regulator 20 is arranged and constructed to control the fuel pressure (the pressure of the liquid fuel fed to the second fuel conduit 52 from the fuel pump 16). Also, the pressure regulator 20 is arranged and constructed to discharge excess liquid fuel (return liquid fuel) generated by pressure controlling operation of the pressure regulator 20 into the reservoir cup 14. Further, because the pressure regulator 20 has a known structure, a detailed description of the pressure regulator may be omitted.

As shown in FIG. 1, the jet pump 22 is disposed in the reservoir cup 14, so as to be positioned closer to a bottom wall 14*b* of the reservoir cup 14. The jet pump 22 may preferably be composed of a horizontally extending cylindrical pump housing 54, and a tapered nozzle 55 that is disposed in the pump housing 54. A suction port 56 is formed in the pump hosing 54, so as to be positioned adjacent to a tip of the nozzle 55. Conversely, an opening 57 is formed in the bottom wall 14*b* of the reservoir cup 14, so as to be aligned with the suction port 56 of the pump housing 54. A proximal end of the pump housing 54 is connected to the fuel jet conduit pipe 37, so that the pressurized liquid fuel (drive fuel) pumped out of the second outlet port 36 of the fuel pump 16 can be fed to the jet pump 22 via the fuel jet conduit pipe 37. When the pressurized liquid fuel (drive fuel) fed to the jet pump 22 via the fuel jet conduit pipe 37 is injected from the nozzle 55, the liquid fuel outside of the reservoir cup 14 is introduced (drawn) into the pump housing 54 via the suction port 56 through the opening 57 of the reservoir cup 14. The liquid fuel is then introduced into the reservoir cup 14 through a distal end of the pump housing 54 with the liquid fuel injected from the nozzle 55. Thus, the jet pump 22 may function to introduce the liquid fuel outside of the reservoir cup 14 into the reservoir cup 14 with the aid of flow of the drive fuel.

As shown in FIG. 1, a flow rate control valve 60 is disposed in the fuel jet conduit pipe 37, so as to control a flow rate (which will be referred to as a jet fuel flow rate Q1) of the drive fuel fed to the jet pump 22 depending upon a total flow rate (which will be referred to as a pumping rate PQ) of the pressurized liquid fuel pumped from the fuel pump 16. The flow rate control valve 60 may preferably be positioned at an upstream portion of the fuel jet conduit pipe 37. In particular, the flow rate control valve 60 may preferably be positioned adjacent to the second outlet port 36. The flow rate control valve 60 may preferably be composed of a valve seat 61 secured to the fuel jet conduit, pipe 37, a valve body 62 positioned downstream (an upper side in FIG. 1) of the valve seat 61, a spring (coil spring) 63, and a spring stopper 64 secured to the fuel jet conduit pipe 37. The valve body 62 is capable of moving toward and away from the valve seat 61. The coil spring 63 is positioned between the valve body 62 and the spring stopper 64, so as to normally bias the valve body 62 toward the valve seat 61 (toward downwardly in FIG. 1). Further, the spring stopper 64 may preferably be arranged and constructed such that the liquid fuel can freely flow therethrough.

When the liquid fuel is pumped upon actuation of the fuel pump 16, the valve body 62 can be spaced away from the valve seat 61 against a spring force of the coil spring 63 by the pressure of the pumped liquid fuel. As a result, the flow rate control valve 60 can be opened, so that the liquid fuel can flow to the fuel jet pipe 37 (the fuel jet path) via the second outlet port 36. As will be recognized, a moving distance (a valve stroke) of the valve body 62 can be changed depending upon a pumping pressure of the fuel pump 16 (i.e., a pressure of the pumped liquid fuel pumped from the fuel pump 16). As a result, a flow rate of the drive fuel fed to the jet pump 22 can be changed depending upon the pumping pressure of the fuel pump 16. Conversely, when the fuel pump 16 is deactuated, the valve body 62 can be pressed to the valve seat 61 by the spring of the coil spring 63. As a result, the flow rate control valve 60 can be closed, so that the liquid fuel pumped from the fuel pump 16 can be prevented from flowing into the fuel jet pipe 37. That is, the moving distance of the valve body 62 can be changed depending upon the pumping pressure of the fuel pump 16, so that a valve opening area of the flow rate control valve 60 (which area corresponds to an opening area of the fuel jet pipe 37) can be changed. Thus, the flow rate control valve 60 may preferably be constructed as a pressure-dependent variable valve.

Next, operation of the fuel-feeding device 10 thus constructed will be described in detail.

When the fuel pump 16 is actuated (when the motor 26*a* is actuated), the impeller 29 coupled to the motor shaft 26*b* of the motor 26*a* is rotated, so that the liquid fuel in the reservoir cup 14 can be introduced into the motor housing 33 via the fuel filtering bag 32, the fuel inlet port 31, the pump cavity 30 and the fuel outlet port 34. The liquid fuel introduced into the motor housing 33 is then pumped out of the first and second outlet ports 35 and 36 of the fuel pump 16. The liquid fuel pumped out of the first outlet port 35 of the fuel pump 16 is fed to the fuel filter 18 via the first fuel conduit 50, so as to be filtrated by the filter element 48 of the fuel filter 18. The filtered liquid fuel is then fed to the engine via the second fuel conduit 52. Further, the pressure of the liquid fuel pumped out of the first outlet port 35 is controlled by the pressure regulator 20 attached to the fuel filter 18. The excess liquid fuel (the return liquid fuel) generated by the pressure controlling operation of the pressure regulator 20 is discharged from the pressure regulator 20 into the reservoir cup 14.

Conversely, the pressurized liquid fuel pumped from the second outlet port 36 of the fuel pump 16 is fed to the jet pump 22 via the fuel jet conduit pipe 37. The pressurized liquid fuel fed to the jet pump 22 is injected from the nozzle 55. As a result, as previously described, the liquid fuel outside of the reservoir cup 14 is introduced (drawn) into the pump housing 54 via the suction port 56 through the opening 57 of the reservoir cup 14. The liquid fuel thus introduced is then transferred to the reservoir cup 14 through the distal end of the pump housing 54 with the liquid fuel injected from the nozzle 55.

Further, when the fuel pump 16 is deactuated, the pressure holding valve 40 is closed by the pressure of the liquid fuel in the fuel feeder path (the first conduit pipe 50, the fuel filer 18 and the second conduit pipe 52). As a result, the pressure of the liquid fuel in the fuel feeder path can be maintained as the residual pressure. Conversely, at this time, the flow rate control valve 60 is closed by the spring force of the coil spring 63.

As described above, the fuel feeder path squeezing portion (the squeezing portion 41 of the pressure holding valve 40) is disposed in the first outlet port 35 that is positioned downstream of the second outlet port 36 (the branching portion) in the fuel feeder path between the pump portion 27 of the fuel pump 16 and the pressure regulator 20. Therefore, when the fuel pump 16 is actuated, a pressure (which will be referred to as an upstream fuel pressure P2) of the liquid fuel in upstream of the fuel feeder path squeezing portion (the squeezing portion 41) may preferably be increased.

Also, as will be recognized, depending on the pumping rate PQ of the pressurized liquid fuel pumped from the fuel pump 16, a flow rate (which will be referred to as a squeezed fuel flow rate Q) of the liquid fuel passing through the fuel feeder path squeezing portion (the squeezing portion 41) may preferably be changed. The squeezed fuel flow rate Q can be generally determined by the following equation:

$$Q=QE+Q3$$

where QE is a flow rate (feed fuel flow rate) of the liquid fuel fed to the engine after the pressure controlling operation of the pressure regulator 20 is performed, and Q3 is a flow rate (return fuel flow rate) of the excess liquid fuel (the return liquid fuel) generated and discharged by the pressure controlling operation of the pressure regulator 20.

Generally, when the squeezed fuel flow rate Q is low, the upstream fuel pressure P2 is relatively low. Conversely, when the squeezed fuel flow rate Q is high, the upstream fuel pressure P2 is relatively high.

The flow rate control valve 60 disposed in the fuel jet conduit pipe 37 may preferably be positioned upstream of the fuel feeder path squeezing portion (the squeezing portion 41) in the fuel feeder path. Therefore, when the upstream fuel pressure P2 is relatively low, the moving distance of the valve body 62 of the flow rate control valve 60 is relatively reduced or shortened. As a result, the flow rate (the jet fuel flow rate Q1) of the liquid fuel fed to the jet pump 22 via the fuel jet conduit pipe 37 can be reduced. Conversely, when the upstream fuel pressure P2 is relatively high, the moving distance of the valve body 62 of the flow rate control valve 60 is relatively increased or lengthened. As a result, the jet fuel flow rate Q1 can be increased.

Thus, depending on the pumping rate PQ of the pressurized liquid fuel pumped from the fuel pump 16, the jet fuel flow rate Q1 can be proportionally changed. As a result, a flow rate (which will be referred to as an introduction fuel flow rate Q2) of the liquid fuel introduced into the reservoir cup 14 from outside of the reservoir cup 14 by the jet pump 22 can be proportionally changed. Therefore, the introduction fuel flow rate Q2 can be controlled so as to have a desired rate corresponding to the feed fuel flow rate QE ($Q2 \geqq QE$).

According to the fuel-feeding device 10 (FIG. 1), the flow rate control valve 60 disposed in the fuel jet conduit pipe 37 may preferably change the jet fuel flow rate Q1 (i.e., the flow rate of the liquid fuel fed to the jet pump 22) depending upon the pumping rate PQ of the pressurized liquid fuel pumped from the fuel pump 16. Therefore, when the pumping rate PQ of the liquid fuel pumped from the fuel pump 16 is low (i.e., when the pumping pressure of the fuel pump 16 is low), the jet fuel flow rate Q1 may preferably be reduced depending upon the pumping rate PQ. As a result, the squeezed fuel flow rate Q (the feed fuel flow rate QE) may preferably be prevented from being excessively reduced. That is, when the pumping pressure of the fuel pump 16 is low, the squeezed fuel flow rate Q may preferably be relatively increased compared to the jet fuel flow rate Q1. Therefore, when a reduced volume of liquid fuel should be fed to the engine (i.e., when the feed fuel flow rate QE is low), the fuel pump 16 can be actuated at a relatively low speed (low load). This may lead to a reduction of power consumption and a long service life of the fuel pump 16.

Further, at the start of actuation of the fuel pump 16, the pumping rate PQ of the liquid fuel pumped from the fuel pump 16 is low, so that the flow rate control valve 60 can be substantially closed. Therefore, the fuel pressure of the liquid fuel fed to the fuel feeder path from the fuel pump 16 can be quickly increased to a desired pressure (which may be referred to as a system fuel pressure). This may lead to improved startability of the engine.

Further, the suction fuel flow rate Q2 (the flow rate of the liquid fuel introduced into the reservoir cup 14 by the jet pump 22) can be changed depending upon the pumping rate PQ of the pressurized liquid fuel pumped from the fuel pump 16 over a wide range from a condition in which the pumping rate PQ is low (i.e., a low pumping pressure condition of the fuel pump 16) to a condition in which the pumping rate PQ is high (i.e., a high pumping pressure condition of the fuel pump 16). The change of the suction fuel flow rate Q2 can be performed without changing a bore size of the nozzle 55 of the jet pump 22. This may lead to a reduced manufacturing cost of the fuel-feeding device 10.

Further, the fuel pump 16 may preferably be connected to a control unit (not shown) such that the pumping rate PQ can be controllably changed continuously or discontinuously.

As described above, the flow rate control valve 60 may preferably be constructed as the pressure-dependent variable valve. That is, the moving distance of the valve body 62 can be changed depending upon the pumping pressure of the fuel pump 16, so that the valve opening area of the flow rate control valve 60 can be changed. As a result, the flow rate (the jet fuel flow rate Q1) of the liquid fuel fed to the jet pump 22 via the fuel jet conduit pipe 37 can be easily changed. In addition, the flow rate control valve 60 thus constructed does not require an actuator, a control device or other such additional devices. This may lead to simplification of the fuel-feeding device 10.

As previously described, the fuel jet path (the fuel jet conduit pipe 37) is branched from the fuel feeder path between the pump portion 27 of the fuel pump 16 and the pressure regulator 20 via the branching portion (the second outlet port 36) that is positioned upstream of the first outlet port 35. That is, the fuel feeder path squeezing portion (the squeezing portion 41 of the pressure holding valve 40) is positioned downstream of the branching portion (the second outlet port 36) in the fuel feeder path. The fuel feeder path squeezing portion thus positioned may preferably contribute to increasing a pressure of the liquid fuel in the fuel jet conduit pipe 37 as well as the pressure (the upstream fuel pressure P2) of the liquid fuel in upstream of the fuel feeder path squeezing portion in the fuel feeder path. Therefore, the fuel liquid in the fuel jet conduit pipe 37 can flow toward the jet pump 22 at an increased flow speed.

Further, in this embodiment, the fuel feeder path squeezing portion is composed of the squeezing portion 41 of the pressure holding valve 40. Therefore, the fuel-feeding device 10 can be structurally simplified.

In addition, the fuel jet path (the fuel jet conduit pipe 37) is branched from the fuel feeder path via the branching portion (the second outlet port 36) that is positioned in parallel with the first outlet port 35. Therefore, in comparison with a case in which the fuel jet path (the fuel jet conduit pipe 37) is branched from the fuel feeder path via the pressure regulator 20, the bore size of the nozzle 55 of the jet pump 22 can be reduced regardless of a back pressure. As a result, the jet pump 22 may have an increased efficiency.

Second Embodiment

The second detailed representative embodiment will now described with reference to FIGS. 3 to 5.

Because the second embodiment relates to the first embodiment, only the constructions and elements that are different from the first embodiment will be explained in detail. Elements that are the same in the first and second embodiments will be identified by the same reference numerals and a detailed description of such elements may be omitted.

Figure 3:
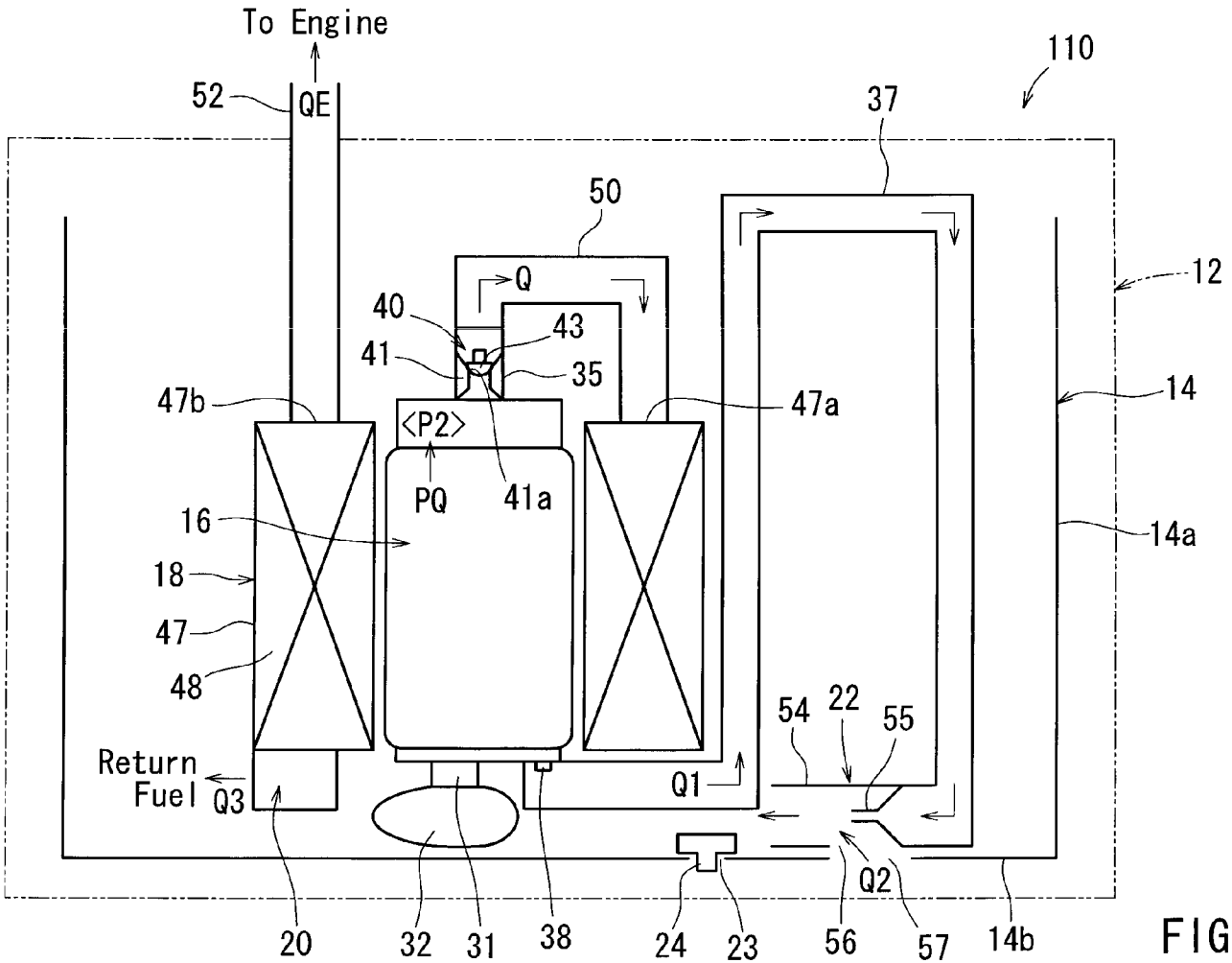
FIG. 3 is a schematic diagram of a fuel-feeding device according to a second embodiment of the present invention.

In a fuel-feeding device 110 of this embodiment, as shown in FIG. 3, the second outlet port 36 in the first embodiment is omitted. Instead, the vapor jet port 38 communicates with the jet pump 22 via the fuel jet conduit pipe 37. That is, the fuel jet path (the fuel jet conduit pipe 37) is substantially branched from the pump cavity 30 (a portion of the fuel feeder path) of the fuel pump 16. Further, in this embodiment, the vapor jet port 38 constitutes the branching portion of the fuel jet path.

Figure 4:
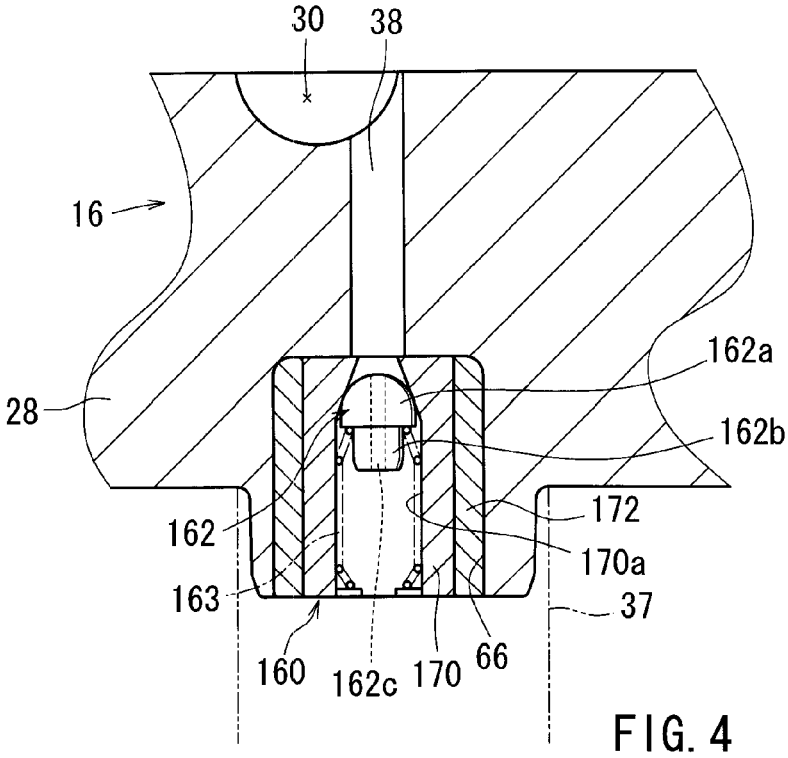
FIG. 4 is a partially cross-sectional view of a fuel pump having a flow control valve used in the fuel-feeding device.

Further, as shown in FIG. 4, a flow rate control valve 160 corresponding to the flow rate control valve 60 of the first embodiment is disposed in the vapor jet port 38 and not in the fuel jet conduit pipe 37. In particular, the flow rate control valve 160 may preferably be fitted into a recessed portion 66 formed in the pump housing 28 of the fuel pump 16. Further, the recessed portion 66 may preferably be formed so as to be axially aligned with the vapor jet port 38.

Figure 5:
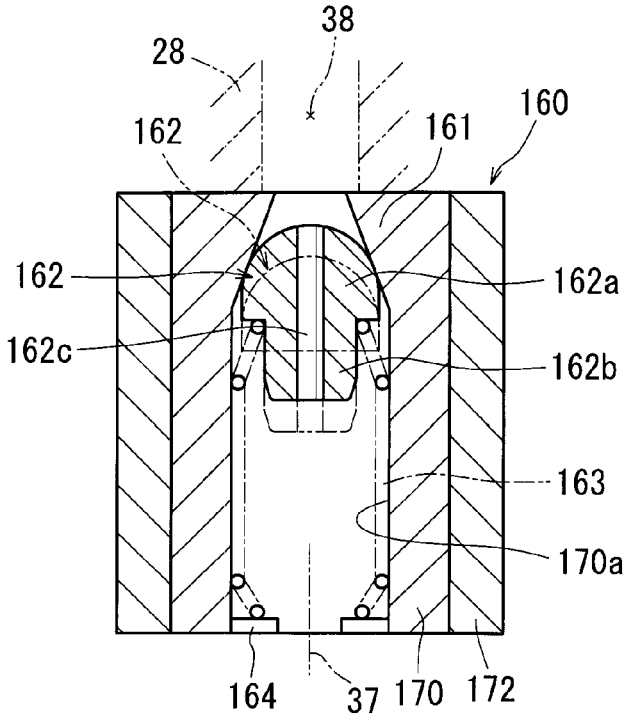
FIG. 5 is an enlarged cross-sectional view of the flow control valve.

As best shown in FIG. 5, the flow rate control valve 160 may preferably be composed of a cylindrical valve housing 170 having an axial through bore 170*a* formed therein, a valve body 162, a spring (coil spring) 163, and a spring stopper 164 secured to a lower end of the through bore 170*a*. The through bore 170*a* may preferably be arranged so as to be aligned with the vapor jet port 38 (FIG. 4). Further, an upper (upstream) end portion of the through bore 170*a* is upwardly tapered, so that a valve seat 161 is integrally formed in the valve housing 170. The valve body 162 is disposed in the through bore 170*a* so as to move toward and away from the valve seat 161. The coil spring 163 is positioned between the valve body 162 and the spring stopper 164, so as to normally bias the valve body 162 toward the valve seat 161 (toward upwardly in FIGS. 4 and 5). As will be appreciated, the moving distance of the valve body 162 can be changed depending upon the pumping pressure of the fuel pump 16, so that a valve opening area of the flow rate control valve 160 (which area corresponds to an opening area of the fuel jet pipe 37) can be changed. Thus, similar to the flow rate control valve 60 of the first embodiment, the flow rate control valve 160 may preferably function as a pressure-dependent variable valve.

As best shown in FIG. 5, the valve body 162 is formed in one piece and is composed of an upper valve head 162*a* and a lower valve stem 162*b*. The valve head 162*a* may preferably be hemispherically-shaped so as to be capable of closely contacting the valve seat 161. Conversely, the valve stem 162*b* may preferably be shaped so as to be coupled to the coil spring 163. Further, a through bore (a vapor relief bore) 162*c* may preferably be formed in the valve body 162 so as to longitudinally extend along the valve body 162.

As shown in FIG. 4, the flow rate control valve 160 thus constructed may preferably be fitted into the recessed portion 66 formed in the pump housing 28 of the fuel pump 16 via a cylindrical outer cushioning shell 172 that circumferentially encircles the valve housing 170.

As indicated by solid lines in FIG. 5, when the flow rate (the pumping rate PQ) of the liquid fuel pumped from the fuel pump 16 is low (i.e., when the pumping pressure of the fuel pump 16 is low), the valve body 162 (the valve head 162*a*) can contact the valve seat 161, so that the flow rate control valve 160 can be substantially closed. Conversely, as indicated by broken lines in FIG. 5, when the flow rate (the pumping rate PQ) of the liquid fuel pumped from the fuel pump 16 is high (i.e., when the pumping pressure of the fuel pump 16 is high), the valve body 162 (the valve head 162*a*) can be spaced away from the valve seat 161 against a spring force of the coil spring 163, so that the flow rate control valve 160 can be opened. Further, even if the flow rate control valve 160 is closed, the vapor-containing liquid fuel can be effectively discharged via the through bore 162*c* formed in the valve body 162.

The fuel-feeding device 110 thus constructed may substantially have the same functions and effects as the fuel-feeding device 10 of the first embodiment. Further, in this embodiment, the fuel jet path (the fuel jet conduit pipe 37) is branched from the pump cavity 30 of the fuel pump 16 via the vapor jet port 38. Therefore, the liquid fuel pressurized in the pump cavity 30 can be fed to the jet pump 22 via the fuel jet conduit pipe 37, so that the jet pump 22 can be actuated. In addition, the liquid fuel pressurized in the pump cavity 30 can be easily fed to the jet pump 22 via the fuel jet conduit pipe 37.

Figure 6:
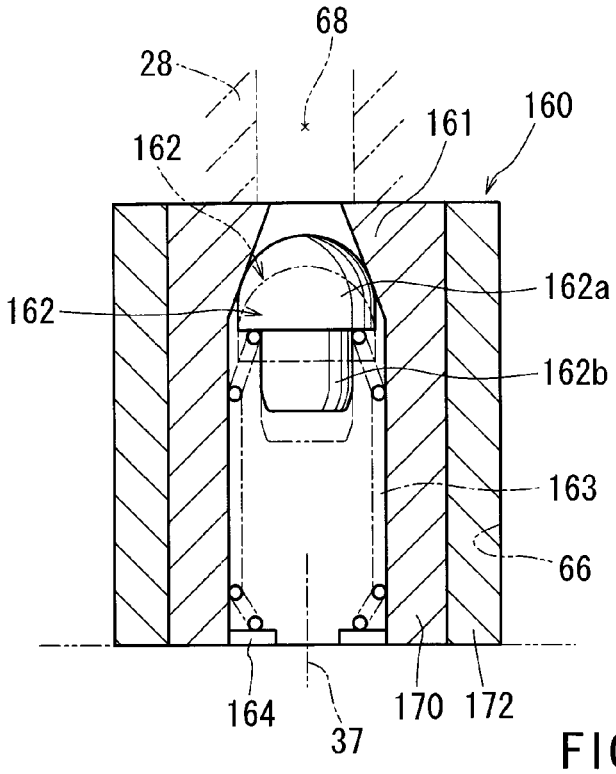
FIG. 6 is a view similar to FIG. 5, which illustrate a first modified form of the flow control valve.

Further, the second embodiment can be modified. For example, an additional port (the relief port) 68 communicating, with the pump cavity 30 can be formed in the pump housing 28. In the modified form, instead of the vapor jet port 38, the additional port 68 communicates with the jet pump 22 via the fuel jet conduit pipe 37. The additional port 68 may preferably be formed in the pump housing 28 so as to be juxtaposed to the vapor jet port 38. Generally, the additional port 68 may preferably be positioned downstream of the vapor jet port 38. Naturally, the recessed portion 66 may preferably be formed so as to be axially aligned with the additional port 68. Further, in the modified form, as shown in FIG. 6, the through bore 162*c* formed in the valve body 162 can be omitted.

In the modified form, similar to the second embodiment, the liquid fuel pressurized in the pump cavity 30 can be fed to the jet pump 22 via the fuel jet conduit pipe 37, so that the jet pump 22 can be actuated.

Figure 7:
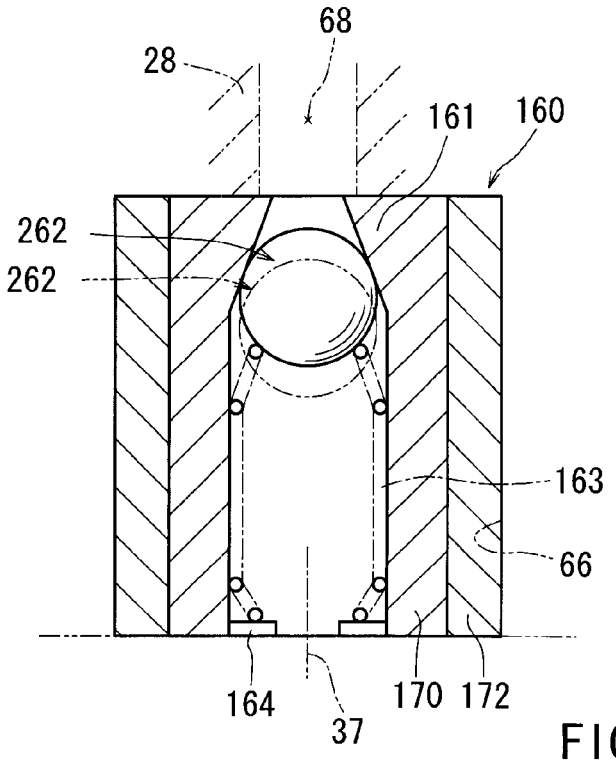
FIG. 7 is a view similar to FIG. 5, which illustrate a second modified form of the flow control valve.

Further, the flow rate control valve 160 can be modified. For example, as shown in FIG. 7, the valve body 162 can be changed to a spherically-shaped valve body 262

Naturally, various changes and modifications may be made to the fuel-feeding device 10 and 110. For example, the position of the flow rate control valve 60 and 160 can be changed in the fuel feeder path, if necessary. Further, an electrically controlled valve can be used as the flow rate control valve 60 and 160. Further, the position of the jet pump 22 can be changed provided that the liquid fuel in the fuel tank 12 can be introduced into the reservoir cup 14. In addition, the fuel tank 12 may be a saddle-shaped tank having a main tank and a secondary tank. In such a case, the jet pump 22 may preferably be arranged so as to transfer the liquid fuel in the secondary tank to the main tank. Further, in the embodiments, although the fuel feeder path squeezing portion is formed in the pressure holding valve 40, the fuel feeder path squeezing portion can be formed separately from the pressure holding valve 40.

Representative examples of the present invention have been described in detail with reference to the attached drawings. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

What is claimed is:

1. A fuel-feeding device, comprising:

a reservoir cup disposed in a fuel tank that contains liquid fuel therein;

a fuel pump capable of feeding the liquid fuel contained in the reservoir cup to an engine; a pressure regulator capable of controlling a fuel pressure of the liquid fuel fed to the engine from the fuel pump;

a jet pump arranged and constructed to receive a part of the pressurized liquid fuel pumped from the fuel pump via a fuel jet path, so as to introduce liquid fuel outside the reservoir cup into to the reservoir cup with the aid of flow of the pressurized liquid fuel; and a flow rate control valve disposed in the fuel jet path, wherein the flow rate control valve is arranged and constructed to control a flow rate of the pressurized liquid fuel fed to the jet pump depending upon a pumping rate of the pressurized liquid fuel pumped from the fuel pump, the fuel jet path is branched from a fuel feeder path between a pump portion of the fuel pump and the pressure regulator via a branching portion, and wherein the fuel feeder path is provided with a fuel feeder path squeezing portion that is positioned downstream of the branching portion.

2. The fuel-feeding device as defined in claim 1, wherein the flow rate control valve comprises a pressure-dependent variable valve in which a moving distance of a valve body thereof can be changed depending upon a pumping pressure of the fuel pump such that an opening area of the fuel jet path can be changed.

3. The fuel-feeding device as defined in claim 1, wherein the fuel feeder path is provided with a pressure holding valve in order to maintain a residual pressure of the liquid fuel in the fuel feeder path when the engine is stopped, and wherein the pressure holding valve has a squeezing portion that constitutes the fuel feeder path squeezing portion.

4. The fuel-feeding device as defined in claim 1, wherein the fuel pump includes a first outlet port that constitutes a portion of the fuel feeder path and a second outlet port that is juxtaposed to the first outlet port, and wherein the second outlet port constitutes the branching portion.

5. The fuel-feeding device as defined in claim 1, wherein the fuel pump includes a relief port communicating with a pump cavity of the fuel pump, and wherein the relief port constitutes the branching portion.

6. The fuel-feeding device as defined in claim 5, wherein the relief port comprises a vapor jet port or an additional port juxtaposed to the vapor jet port.

* * * * *